US006874337B2

(12) United States Patent
Uno et al.

(10) Patent No.: US 6,874,337 B2
(45) Date of Patent: Apr. 5, 2005

(54) UNDERPANT GARMENT

(75) Inventors: Hidekazu Uno, Osaka (JP); Tatsuo Sakaguchi, Osaka (JP); Eiji Kaname, Osaka (JP); Shoji Osada, Osaka (JP)

(73) Assignee: Mizuno Corporation, Osaka (JP)

( * ) Notice: Subject to any disclaimer, the term of this patent is extended or adjusted under 35 U.S.C. 154(b) by 13 days.

(21) Appl. No.: 10/449,048

(22) Filed: May 30, 2003

(65) Prior Publication Data

US 2004/0016043 A1 Jan. 29, 2004

(30) Foreign Application Priority Data

Jun. 5, 2002 (JP) ..... 2002-163680

(51) Int. Cl.[7] ..... A41B 9/00
(52) U.S. Cl. ..... 66/177; 2/401
(58) Field of Search ..... 66/175, 176, 177; 2/401, 227, 228, 239, 240; 450/97, 98

(56) References Cited

U.S. PATENT DOCUMENTS 2,928,397 A * 3/1960 Pucci ..... 450/99
2,962,026 A * 11/1960 Hanken ..... 450/99
3,339,554 A * 9/1967 Nobbs ..... 450/104
3,413,824 A * 12/1968 Kuney ..... 66/177
3,526,229 A * 9/1970 Blair ..... 450/118
5,590,548 A * 1/1997 Osborne ..... 66/177
5,611,722 A * 3/1997 Osborne ..... 450/99
5,787,732 A * 8/1998 Perron et al. ..... 66/177
5,888,118 A * 3/1999 Kishi ..... 450/122
6,186,970 B1 2/2001 Fuji et al.

FOREIGN PATENT DOCUMENTS

JP 10-110306 4/1998
JP 11-012814 1/1999
JP 3012819 12/1999
JP 3241608 10/2001

* cited by examiner

*Primary Examiner*—Danny Worrell
(74) *Attorney, Agent, or Firm*—Merchant & Gould P.C.

(57) ABSTRACT

An underpant garment worn in a state of being substantially in close contact with a surface of a lower body of a wearer includes a main constituent portion made of stretchable materials that include a first-type material and a second-type material. The first-type material has a straining force greater than a straining force of the second-type material. In the underpant garment, the first-type material is arranged in regions such that in each region the first-type material covers at least a region including a part of musculus gluteus maximus, a part of musculus gluteus medius, a part of musculus tensor faciae latae, and a part of tractus iliotibialis, and the second-type material is arranged in regions other than the regions where the first-type material is arranged. This allows the wearer to smoothly shift from a static state to a dynamic state such as a running state, and helps prevent a displacement of the center of gravity when the wearer is in motion.

26 Claims, 3 Drawing Sheets

UNDERPANT GARMENT

BACKGROUND OF THE INVENTION

1. Field of the Invention

The present invention relates generally to an underpant garment that is worn in a state of being substantially in close contact with a surface of a lower body of a wearer, and particularly to an underpant garment that is worn underneath a pair of baseball sliding pants, for allowing the wearer to smoothly perform a motion in shifting from a static state such as a fielding or batting stance to a dynamic state such as a state during running, which motion important in baseball, and for suppressing a displacement of the center of gravity when the wearer is in motion.

2. Related Background Art

A pair of baseball sliding pants is to be worn underneath a pair of uniform pants, and conventionally it is intended to absorb shock upon sliding and to protect the legs from skin injury when the uniform pants are torn. Therefore, it is provided with a polyurethane foam or a piece of cotton-filled kilting on a region corresponding to the hips or the like. However, as materials that are not torn easily are developed for uniform pants and shock-absorbing pads are attached inside and outside uniform pants, the purpose of the wearing of the sliding pants has shifted from the shock absorption or the protection of the legs from skin injury to the improvement of the motor functionality and the protection of muscles and joints. Fabrics to be used have shifted from those having high shock absorbing properties to those having greater stretchabilities. The shape of such a garment has shifted from a shape with a greater degree of allowance to a shape with a smaller degree of allowance and with improved fitting so as to be substantially in close contact with a surface of the wearer's lower body. Although there are some types of sliding pants must employ light and firm-fitting materials to improve motor functionality, they only rely on the lightness and stretchability of the fabrics used therein, and are not intended to actively support the wearer's motion.

Further, in addition to baseball sliding pants, various types of tights and pants intended to improve motor functionality and to protect muscles and joints are, known.

The leg-protective clothing disclosed in the Japanese Patent No. 3012819 includes at least a lower section to cover a lower human body. The lower section includes leg portions each reaching up to or over a kneecap. The clothing is made of stretchable cloth that includes parts each exerting a strong straining force. Each stretchable cloth part exerting a strong straining force extends at least from a superior side of the trochanter major, through the trochanter major, along the vicinity of a border between the musculus biceps femoris and the tractus iliotibialis for supporting the biceps femoris, then, traverses aslant the vicinity of the tendon under the venter of the biceps femoris without traversing the venter thereof itself, and finally reaches the vicinity of an upper end of the tibia. This leg-protective-clothing is intended to protect the legs during games of various sports such as baseball, Rugby, football, etc., and particularly to support hamstrings, which are muscles on the posterior side of the femoral region, so as to keep the balance of muscles, protect the knee joints and the hip joints as a whole, and aid their motions.

A lower body garment disclosed by Japanese Patent No. 3241608 is composed of an anterior part, a posterior part, a lateral part, a waist posterior extension, and a medial part, which are made in respective patterns suitable for accommodating different types of movement. A lateral knee-supporting part for supporting a knee lateral region is sewn onto outer faces of the lateral and anterior parts. A medial knee-supporting part for supporting a knee medial region is sewn onto outer faces of the medial and anterior parts. The supporting parts are distanced so as to have gaps between ends thereof. The anterior part, the posterior part, and the medial part are made of a tricot fabric having a normal stretchability, and the lateral part, the waist posterior extension, and the supporting parts are made of a tricot fabric having a stronger stretchability than that of the anterior part. This lower-body garment is configured so as to have sufficient adaptability to accommodate different types of movement, and to allow the mutually interrelated motions of the hip and the leg to be reinforced, without compression or excessive tightness, as well as to support the ligamentum collateralle medialis and the ligamentum collateralle lateralis of the knee joint.

The tights disclosed in JP 11(1999)-12814 A are configured so that lateral-side members and medial-side members, each made of a material having a high stretch strength, are disposed in regions of the tights corresponding to the lateral side of the body and the medial side of the knee, respectively. The tops of both the medial-side member and the lateral-side member are abutted against each other in chevron-fashion under a position on an inferior side of the knee and both the medial-side and lateral-side members are sewn and connected to each other to form a structure that supports the knee in a manner comparable to athletic tape. Calf members made of a material having a high stretch strength are disposed on both sides of a position corresponding to a position below the calf of the lower femoral part, and are opposed to each other in closer proximity to each other below the calf position to construct a structure that supports the calf in a manner comparable to athletic tape.

As described above, the leg-protective-clothing of JP 3012819 is intended to support hamstrings, which are muscles on the posterior side of the femoral region so as to keep the balance of muscles, to protect the knee joints and the hip joints as a whole, and to aid their motions. The underwear of JP 3241608 mainly is intended to allow the mutually interrelated motions of the hip and the leg to be reinforced, as well as to support the ligamentum collateralle medialis and the ligamentum collateralle lateralis of the knee joint. The tights of JP 11(1999)-12814 A protect the ligament of the femoral region, the ligament of the calf, and the Achilles tendon in the same manner as athletic tape.

The above-described articles of clothing are intended to protect the hips and the joints in motion, to aid motions by devising an arrangement of materials, and facilitate motion of the legs, particularly the lower thighs, but do not provide a function of encouraging the wearer to smoothly shift from a static state such as the fielding or batting stance to a dynamic state such as a state during running, which is particularly important in baseball, or a function of preventing a displacement of the center of gravity when the wearer is in motion.

SUMMARY OF THE INVENTION

Therefore, with the foregoing in mind, it is an object of the present invention to provide an underpant garment that encourages the wearer to smoothly shift from a static state to a dynamic state such as a running state and suppresses a displacement of the center of gravity when the wearer is in motion, by providing materials having different straining forces according to predetermined regions.

To achieve the foregoing object, an underpant garment of the present invention is an underpant garment that is worn in a state of being substantially in close contact with a surface of a lower body of a wearer, and that includes a main constituent portion made of stretchable materials that include a first-type material and a second-type material. The first-type material has a straining force greater than a straining force of the second-type material. In the underpant garment, the first-type material is arranged in regions such that in each region the first-type material covers at least a region including a part of musculus gluteus maximus, a part of musculus gluteus medius, a part of musculus tensor faciae latae, and a part of tractus iliotibialis, and the second-type material is arranged in regions other than the regions where the first-type material is arranged.

DETAILED DESCRIPTION OF THE INVENTION

Figure 3A:
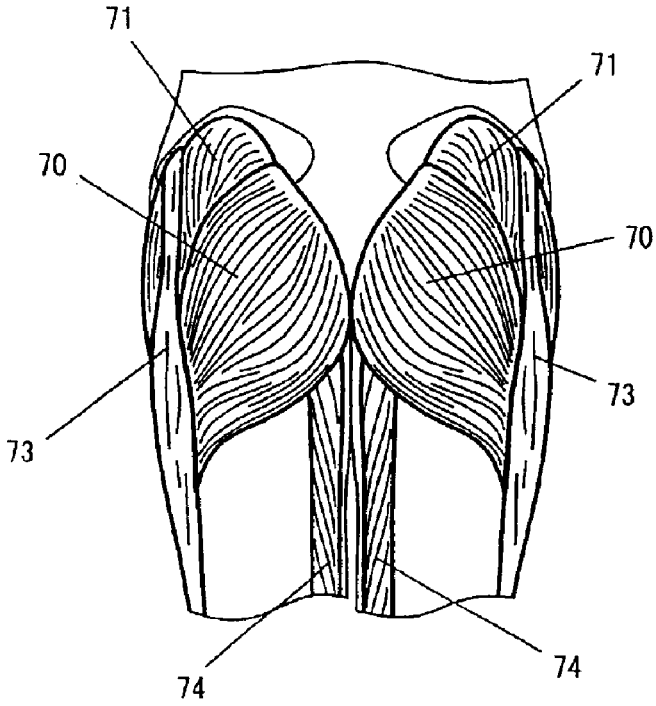
FIG. 3A is an explanatory view of muscles relevant to the present invention viewed from the posterior side.
Figure 3B:
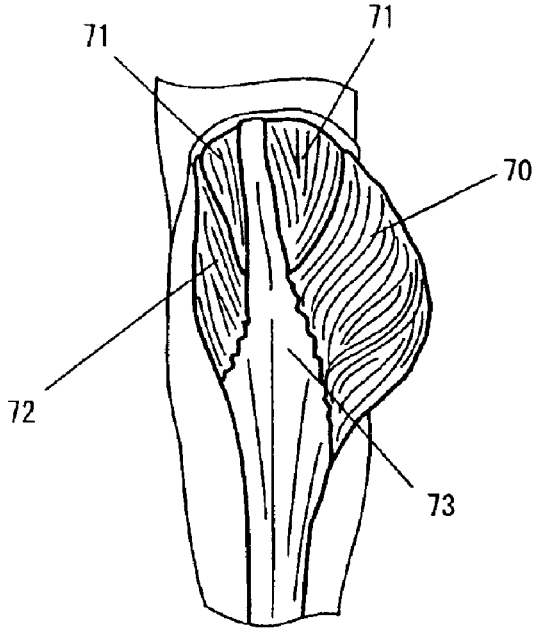
FIG. 3B is an explanatory view illustrating muscles relevant to the present invention viewed from a medial side.

In baseball games, in order to cause the wearer to smoothly shift from a static state such as the fielding or batting stance to a dynamic state such as a state during running, it is important to reproduce, by using an underpant garment, a state in which a constant pressure is applied to the gluteal region, the right and left waist regions, and the lateral parts of the femoral regions, that is, a state in which regions each including the musculus gluteus maximus 70, the musculus gluteus medius 71, the musculus tensor faciae latae 72, and the upper portion 73 of the tractus iliotibialis shown in FIGS. 3A and 3B are pressed constantly from a posterior side. This is implemented by arranging pieces of a fabric that cannot be stretched without a strong force (hereinafter referred to as "strong-straining-force material" (first-type material)) in regions of the underpant garment each corresponding to the musculus gluteus maximus 70, the musculus gluteus medius 71, the musculus tensor faciae latae 72, and the upper portion 73 of the tractus iliotibialis. By arranging such pieces of the strong-straining-force fabric material in the foregoing regions, when the wearer is in a semi-crouching posture during fielding or in a semi-erect posture during batting, the pieces of the fabric in the foregoing regions are stretched, causing the pressure applied to the skin of the wearer to increase. Therefore, the wearer feels constant pressure from the posterior side. Furthermore, the feeling of pressure from the surface side of the body toward the center of the body prevents a displacement of the wearer's center of gravity when the wearer is in motion, which improves the athletic abilities.

Furthermore, by arranging a strong-straining-force material in a region of the underpant garment each corresponding to an upper portion 74 of the musculus adductor magnus, a pressure is also applied to medial posterior portions of the femoral regions, thereby further increasing the pressure force from the posterior side. At the same time, the feeling of a pressure applied to the foregoing regions adjacent to the center-of-gravity axis causes the wearer to be more conscious of the center of gravity, thereby allowing the wearer to avoid a displacement of the center of gravity when the wearer is in motion.

In the underpant garment according to the present invention, as described above, by arranging pieces of a strong-straining-force material in regions of the underpant garment each corresponding to the musculus gluteus maximus 70, the musculus gluteus medius 71, the musculus tensor faciae latae 72, the upper portion 73 of the tractus iliotibialis, and the upper portion 74 of the musculus adductor magnus, while arranging a fabric material that can be stretched with an intermediate or smaller force (hereinafter referred to as "weak-straining-force material" (second type material)) in the other regions, the athletic abilities as described above can be improved. This effect is exhibited in the case where the underpant garment is worn in a state of being substantially in close contact with the surface of the lower body of the wearer.

In the present invention, to create a state of being "substantially in close contact" with a surface of a human body, the underpant garment is formed so as to have circumferential dimensions of not less than 50% and not more than 110%, preferably not less than 70% and not more than 95% of corresponding dimensions of a naked human body, and lengths of not less than 75% and not more than 100%, preferably not less than 85% and not more than 100% of corresponding lengths of the naked human body. It should be noted that the foregoing ratios are merely estimations since there are individual differences in dimensions of human bodies.

In the present invention, the "main constituent portion" signifies a main fabric portion composing the underpant garment, that is, a fabric portion covering the hips and at least the femoral regions. Further, the strong-straining-force material is arranged in regions such that in each region the strong-straining-force material covers at least a region including a part of the musculus gluteus maximus, a part of the musculus gluteus medius, a part of the musculus tensor faciae latae, and a part of the tractus iliotibialis, but it may be disposed so as to cover regions including the entireties of those muscles.

The foregoing underpant garment may be formed so as to extend to above the knees, to under the knees, or to the ankles. In the case where the underpant garment is formed so as to extend to under the knees or to the ankles, the strong-straining-force material and the weak-straining-force material are arranged appropriately as required.

The foregoing strong-straining-force material and the weak-straining-force material preferably are integrated by sewing. However, in the case where a weft-knitted fabric is used, the underpant garment may be knitted integrally, as will be described later.

The strong-straining-force material and the weak-straining-force material of the present invention are stretchable materials, and it is preferable that both of an extension ratio A of a 5 cm-wide piece of the former and an extension ratio B of a 5 cm-wide piece of the latter wider a load of 17.7 N (1800 gf) are not less than 50%. Furthermore, it is preferable that an extension ratio A of a 5 cm-wide piece of the strong-straining-force material under a load of 4.9 N (500 gf) is not less than 20% and less than 50%, while an extension ratio B of a 5 cm-wide piece of the weak-straining-force material under a load of 4.9 N (500 gf) is in a range of not less than 50%. To obtain such properties of stretchability in the respective portions, the following means are available as examples, in the case where elastic yarns, for instance, are used as constituent yarns for knitted or woven fabrics as will be described later:

(1) increasing a constituent ratio of the elastic yarn in the strong-straining-force material as compared with that in the weak-straining-force material;

(2) increasing a diameter of fibers of the elastic yarn used in the strong-straining-force material as compared with that in the weak-straining-force material;

(3) increasing the warp yarn density and/or the weft yarn density in the strong-straining force material as compared with that in the weak-straining-force material in the case of woven fabrics, or increasing the stitch density in the strong-straining-force material as compared with that in the weak-straining-force material in the case of knitted fabrics;

(4) increasing a tension of the elastic yarn in the strong-straining-force material as compared with that in the weak-straining-force material, in producing the woven or knitted fabrics; and (5) increasing the fabric thickness of the strong-straining-force material as compared with that of the weak-straining-force material, in producing the woven or knitted fabrics.

The stretchable materials of the present invention preferably are of at least one type selected from a two-way stretchable knitted fabric and a two-way stretchable woven fabric that are stretchable in the warp direction and the weft direction.

The foregoing two-way stretchable knitted or woven fabric may employ a polyester fiber yarn and an elastic yarn as main component constituent yarns, or may employ a nylon fiber yarn and an elastic yarn as main component constituent yarns. Here, the main component constituent yarn signifies that a sum of both components accounts for not less than 80 percents by weight (wt %). In the case where a polyester fiber yarn is used, the obtained underpant garment can dry quickly even when the wearer sweats. In the case where a nylon fiber yarn is used, a knitted fabric with softness is obtained.

The foregoing knitted or woven fabric may have any texture. In the case where a woven fabric is used, the woven fabric may have any one of the three basic textures of plain weave, twill weave, and satin weave, which are known commonly, as well as derivative weaves. Further, alternatively, in the case where a knitted fabric is used, the knitted fabric may be a fabric knitted by a raschel warp-knitting machine, a fabric knitted by a tricot warp-knitting machine, a fabric knitted by a weft-knitting machine, which are known commonly, or the like. Examples of such knitted fabrics include a half tricot knitted by the tricot warp-knitting machine, and a power net knitted by the raschel warp-knitting machine. As for weft-knitted fabrics, any texture may be used, such as a plain stitch fabric, a rib stitch fabric, a purl stitch fabric, an interlock stitch (double face stitch) fabric, etc. Furthermore, the fabrics knitted by the weft-knitting machine include fabrics knitted by a circular-knitting machine or a flat-knitting machine. It should be noted that in the case where a weft-knitted fabric is used, the underpant garment can be integrally knitted, without sewing. For such knitting, a machine named "WHOLEGARMENT", manufactured by Shima Seiki Mfg., Ltd., Japan, is used. By using this machine, the waist part and the leg parts can be knitted continuously, whereby a non-sewn knitted item can be produced.

Alternatively, a full-automatic seamless knitting machine for knitting inner bodywear, produced by Santoni S.p.A., Italy, may be used for knitting the strong-straining-force material and the weak-straining-force material in combination in seamless tube forms so as to provide the waist and leg parts.

The foregoing woven or knitted fabric preferably employs an elastic yarn having stretchability, such as polyurethane yarn, at least partially.

The elastic yarn preferably is at least one selected from polyurethane-based elastic yarns, and polyester-based elastic yarns, because they have high stretchability and are suitable for sportswear. The elastic yarn may be any one of bare yarns, and covered yarns whose surfaces are covered with polyester fibers or nylon fibers.

The underpant garment of the present invention is suitable as pants worn underneath a baseball uniform.

A fabric may be used in which a polyester or nylon yarn having been subjected to high bulky crimping (hereinafter referred to as high bulky crimping textured yarn) so as to have stretchability is used in at least a part of the fabric or in an entirety of the same. Furthermore, examples of fabrics that may be used include a fabric obtained by simply laminating a plurality of sheets of the foregoing stretchable knitted fabric. Furthermore, examples of fabrics that may be used also include a two-layer laminated fabric obtained by laminating the stretchable knitted fabrics, and a three-layer laminated fabric obtained by interposing a stretchable polyurethane sheet between the stretchable knitted fabrics and laminating the same.

Next, examples of a method for causing fabrics to have a "strong" straining force and a "weak" straining force to form a strong-straining-force material and a weak-straining-force material, respectively, include a method of increasing/decreasing the content of a polyurethane yarn or a high bulky crimping textured yarn (these yarns hereinafter generally are referred to as stretchable yarns) so that fabric materials having "large, small" contents of the stretchable yarn have "strong, weak" straining forces, respectively. Examples of methods for varying the content of the stretchable yarns include a method of varying the thickness of the stretchable yarn so that fabric materials employing "thick, thin" stretchable yarns have "large, small" contents of the stretchable yarns, respectively, and a method of varying a percentage of the stretchable yarn arranged in the fabric while keeping the thickness of the stretchable yarn uniform so that fabric materials having "large, small" percentages of the stretchable yarn have "large, small" contents of the stretchable yarn, respectively. In the case where the content of the stretchable yarn is uniform, the stitch density may be varied so that the fabric materials having "large, small" densities have "large, small" contents of the stretchable yarn, respectively. Furthermore, by using fabrics employing different types of stretchable yarns, by using a laminated fabric and a non-laminated fabric, or by varying the number of laminated pieces of the same fabric, it also is possible to prepare the fabrics having "strong, weak" straining forces.

The strong and weak straining forces of a strong-straining-force fabric and a weak-straining-force fabric can be determined according to extension ratios thereof when a certain load is applied. More specifically, a fabric having a strong straining force has a small extension ratio, while a fabric having a weak straining force has a great extension ratio.

In the present invention, the "straining force" means the resistance to stretching provided by a material.

To measure extension ratios indicative of a stretchability and a straining force, Universal Tensile Testing Instrument TENSILON UTM-III-200 (manufactured by Toyo Baldwin Co., Ltd.) was used with a tensile strength of 20 cm/min. with respect to a sample piece of 5 cm in width and 30 cm in length, with a space between grips of 20 cm. A load applied for determining the straining force was set to be 4.9 N (500 gf), and a load applied for determining the stretchability was set to be 17.7 N (1800 gf). Extension ratios that will be mentioned below in the description of Examples indicate measurement results obtained by this measuring method.

The underpant garment according to the present invention may be formed by integrally arranging the foregoing strong-straining-force material and weak-straining-force material by sewing or bonding.

For sewing, stitches may be formed by a lock stitch sewing machine, a chain stitch sewing machine, a 1-needle overlock sewing machine, a 2-needle overlock sewing machine, or a flat seamer, etc. However, the stitches to be formed for sewing are not limited to these. It should be noted that stitches formed by the 1-needle overlock sewing machine, the 2-needle overlock sewing machine, or the flat seamer are used desirably, since such stitches have stretchability and cause minimum discomfort when the underpant garment is worn.

For bonding, thermocompression bonding, for instance, is used in which two types of fabrics (members) to be integrated are made to have extra portions to be overlapped (overlap portions), a polyurethane seam tape that is molten with heat, penetrates into the fabric, and is cured while cooling, is interposed between the overlap portions and are subjected to hot pressing so that the fabrics are bonded with each other. Here, it is desirable, as in sewing, that the overlap portions have stretchability so as to avoid discomfort when the underpant garment is worn.

The underpant garment of the present invention also may be applicable to other types of sports such as golf, tennis, badminton, squash racquets, racquetball, hockey, jogging, etc.

EXAMPLES

The following will describe examples of the underpant garment according to the present invention, while referring to FIGS. 1A to 1C and 2A to 2C.

Figure 1A:
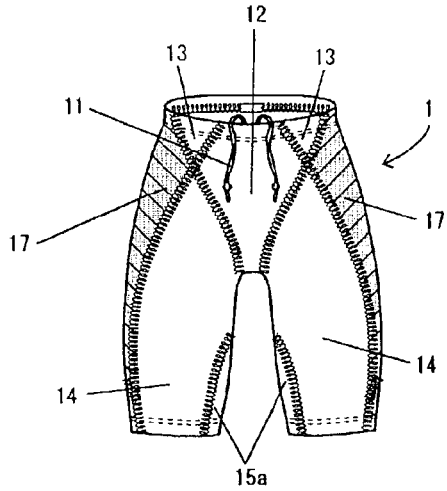
FIG. 1A is a front view of an example of a baseball underpant garment according to the present invention.
Figure 1B:
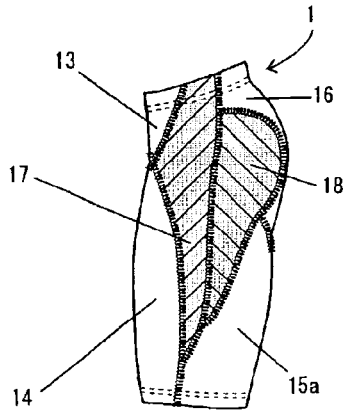
FIG. 1B is a side view of the same.
Figure 1C:
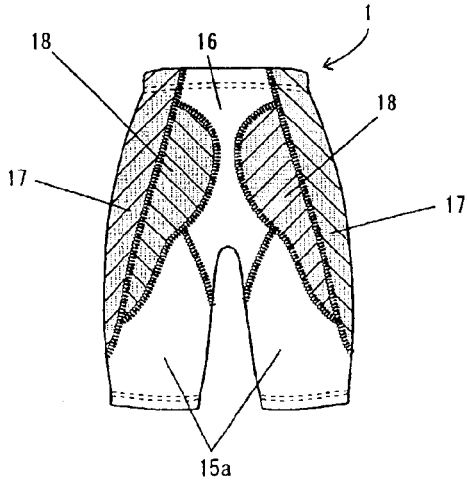
FIG. 1C is a back view of the same.

FIG. 1A is a front view of an underpant garment, FIG. 1B is a side view of the same, and FIG. 1C is a back view of the same.

The underpant garment 1 of the present example was composed of a center anterior portion 12, side anterior portions 13, femoral region anterior portions 14, femoral region posterior portions 15*a*, a posterior portion 16, lateral anterior portions 17, lateral posterior portions 18, and a waist string 11 used for tightening the underpant garment. Among the foregoing members, the side anterior portions 13, the femoral region anterior portions 14, the femoral region posterior portions 15*a*, the lateral anterior portions 17, and the lateral posterior portions 18 were arranged symmetrically on the left and right sides. In the present example, the members were sewn with one another integrally so as to form the underpant garment. For sewing, a flat seamer sewing machine was used to form flat seam stitches with the use of a polyester spun-like filament thread for a needle thread, and wooly nylon threads for upper and lower looper threads.

The lateral anterior portions 17 and the lateral posterior portions 18 were formed using a strong-straining-force material (hatched portions in the drawings), which was disposed in regions each of which ranged over the musculus gluteus maximus, the musculus gluteus medius, the musculus tensor faciae latae, and an upper portion of the tractus iliotibialis of the wearer. As the strong-straining-force material, a plain-knitted fabric was used that was knitted with a 136-decitex (dtex) polyester filament twine thread and a 64-dtex polyurethane bare yarn, at a mixture ratio of 85 wt % of polyester and 15 wt % of polyurethane, by a 30 G-gauge circular-knitting machine. The foregoing material exhibited an extension ratio of 35% under a load of 4.9 N (500 gf), which is indicative of a straining force, and an extension ratio of 90% under a load of 17.7 N (1800 gf), which is indicative of a stretchability. It had a weight per unit area (density) of 320 g/m.sup.2.

The central anterior portion 12, the side anterior portions 13, the femoral region anterior portions 14, the femoral region posterior portions 15*a*, and the posterior portion 16 were formed using a weak-straining-force material. As the weak-straining-force material, a plain-knitted fabric was used that was knitted with a 68-dtex polyester filament thread and a 36-dtex polyurethane bare yarn, at a mixture ratio of 85 wt % of polyester and 15 wt % of polyurethane, by a 30 G-gauge circular-knitting machine. The foregoing material exhibited an extension ratio of 70% under a load of 4.9 N (500 gf), which is indicative of a straining force, and an extension ratio of 190% under a load of 17.7 N (1800 gf), which is indicative of a stretchability. It had a weight per unit area (density) of 190 g/m.sup.2.

In the present example, the underpant garment is formed so as to have circumferential dimensions of 80% of corresponding dimensions of a naked human body, and lengths of 90 to 95% of corresponding lengths of the naked human body, so as to create the state of being "substantially in close contact" with a surface of the body.

With the foregoing underpant garment 1 of the present example in which the strong-straining-force material is used for forming the lateral anterior portions 17 and the lateral posterior portions 18 as described above, when the wearer is in a semi-crouching posture during fielding or in a semi-erect posture during batting, the foregoing pieces of the fabric stretch, causing increase of the pressure to be applied to the skin of the wearer. Thus, a state is produced in which the regions of the wearer each including the musculus gluteus maximus, the musculus gluteus medius, the musculus tensor faciae latae, and the upper portion of the tractus iliotibialis shown in FIGS. 3A and 3B are pressed constantly from the posterior side. Furthermore, the feeling of the pressure from the surface side of the body toward the center of the body facilitates to suppress a displacement of the center of gravity when the wearer is in motion, which improves the athletic abilities.

Figure 2A:
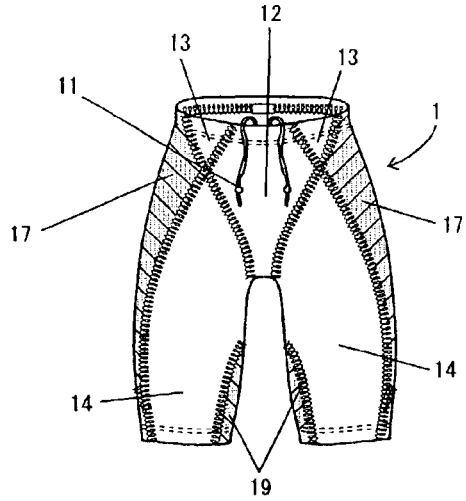
FIG. 2A is a front view of another example of a baseball underpant garment according to the present invention.
Figure 2B:
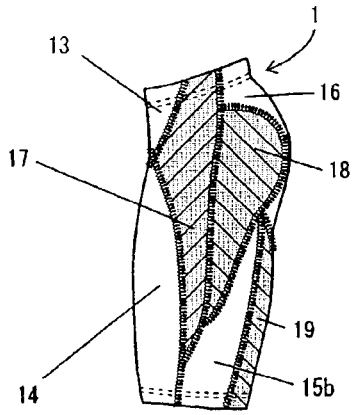
FIG. 2B is a side view of the same.
Figure 2C:
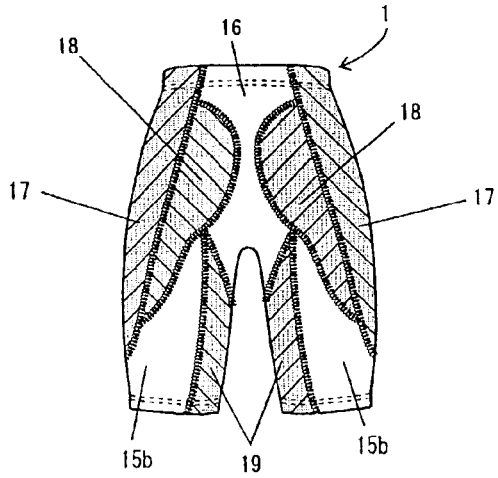
FIG. 2C is a back view of the same.

FIG. 2A is a front view of another example of an underpant garment, FIG. 2B is a side view of the same, and FIG. 2C is a back view of the same.

Though the femoral region posterior portion 15*a* in the example shown in FIGS. 1A to 1C was composed of a single member, the same member was divided into a femoral region posterior portion 15*b* and a femoral region medial portion 19 in the present example. The femoral region posterior portion 15*b* was made of a weak-straining-force material, while the femoral region medial portion 19 was made of a strong-straining-force material. The other members were made of the same materials as those in the example shown in FIGS. 1A to 1C, and the same sewing method as that in the example shown in FIGS. 1A to 1C was applied.

Since the strong-straining-force material is arranged for forming the femoral region medial portions 19 in the present example, a state in which a pressure is applied to regions of the wearer each including the upper portion of the musculus adductor magnus shown in FIGS. 3A and 3B is reproduced with the underpant garment. Thus, in addition to the effect described in conjunction with the example shown in FIGS. 1A to 1C, a pressure is applied also to medial posterior portions of the femoral regions, and hence, the state of being pressed from the posterior side is reinforced further. At the same time, the feeling of a pressure applied to the foregoing regions near the center-of-gravity axis causes the wearer to be more conscious of the center of gravity, thereby allowing the wearer to avoid a displacement of the center of gravity when the wearer is in motion.

In the foregoing examples, underpant garments are composed of the center anterior portion 12, the side anterior portions 13, the femoral region anterior portions 14, the femoral region posterior portions 15*a* and 15*b*, the posterior portion 16, the lateral anterior portions 17, the lateral posterior portions 18, and the femoral region medial portions 19, but as long as the foregoing fabric materials having respective straining-forces are disposed in the foregoing regions, shapes of the regions are not limited to those described above.

Furthermore, in the above-described examples, the underpant garments have a length such as to be extended to above the knees, but the length is not limited to this. The underpant garments may have any length in a range such that the objects of the present invention are achieved, for instance, a length to under the knees, or to the ankles.

The lateral anterior portions 17, the lateral posterior portions 18, and the femoral region medial portions 19 may have any widths and sizes as required, respectively, in ranges such that the objects of the present invention are achieved.

FIGS. 1A to 1C and 2A to 2C are views stereoscopically illustrating the underpant garments in actually-worn states, and shapes thereof may be varied slightly according to the wearer's figure, etc.

As described above, with the underpant garment of the foregoing example in which the strong-straining-force material is arranged for forming the lateral anterior portions and the lateral posterior portions, when the wearer is in a semi-crouching posture during fielding or in a semi-erect posture during batting, the pieces of the fabric in the foregoing regions are stretched, causing increased pressure to be applied to the skin of the wearer. Thus, the underpant garment produces a state in which the regions of the wearer each including the musculus gluteus maximus, the musculus gluteus medius, the musculus tensor faciae latae, and the upper portion of the tractus iliotibialis are pressed constantly from the posterior side. Furthermore, the feeling of the pressure from the surface side of the body toward the center of the body helps prevent a displacement of the center of gravity when the wearer is in motion, which improves the athletic abilities.

Furthermore, by arranging the strong-straining-force material so as to cover a region including the femoral region medial portions, a pressure is applied also to medial posterior portions of the femoral regions, and hence, the state of being pressed from the posterior side is increased further. At the same time, the feeling of a pressure applied to the foregoing regions in a more proximity to the center-of-gravity axis causes the wearer to be more conscious of the center of gravity, thereby allowing the wearer to avoid a displacement of the center of gravity when the wearer is in motion.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An underpant garment worn in a state of being substantially in close contact with a surface of a lower body of a wearer, the underpant garment comprising a main constituent portion made of stretchable materials that include a first-type material and a second-type material, the first-type material having a straining force greater than a straining force of the second-type material, wherein the first-type material is arranged in regions such that in each region the first-type material covers at least a region including a part of musculus gluteus maximus, a part of musculus gluteus medius, a part of musculus tensor faciae latae, and a part of tractus iliotibialis, and the second-type material is arranged in regions other than the region where the first-type material is arranged, wherein an extension ratio under a load of 4.9 N (500 gf) of a 5 cm-wide piece of the first-type material is in a range of not less than 20% and less than 50%, while that of a 5 cm-wide piece of the second-type material is in a range of not less than 50%.

2. The underpant garment according to claim 1, wherein the first-type material is arranged so as to further cover at least a portion of musculus adductor in magnus each region.

3. The underpant garment according to claim 1, wherein the first type and second type materials are integrated by sewing.

4. The underpant garment according to claim 1, wherein both of an extension ratio A of a 5 cm-wide piece of the first-type material and an extension ratio B of a 5 cm-wide piece of the second-type material under a load of 17.7 N (1800 gf) are not less than 50%.

5. The underpant garment according to claim 1, wherein each of the first-type material and the second-type material is at least one type of fabric selected from two-way stretchable knitted fabrics and two-way stretchable woven fabrics that are stretchable in a warp direction and a weft direction.

6. The underpant garment according to claim 1, wherein the underpant garment is formed so as to extend to above knees, to under knees, or to ankles.

7. The underpant garment according to claim 5, wherein the two-way stretchable knitted or woven fabric includes a polyester fiber yarn and an elastic yarn as main component constituent yarns.

8. The underpant garment according to claim 5, wherein the two-way stretchable knitted or woven fabric includes a nylon fiber yarn and an elastic yarn as main component constituent yarns.

9. The underpant garment according to claim 5, wherein the two-way stretchable knitted fabric is at least one knitted fabric selected from a fabric knitted by a raschel warp-knitting machine, a fabric knitted by a tricot warp-knitting machine, and a fabric knitted by a weft-knitting machine.

10. The underpant garment according to claim 9, wherein the fabric knitted by a weft-knitting machine is a fabric knitted by a circular-knitting machine or a flat-knitting machine.

11. The underpant garment according to claim 7, wherein the elastic yarn is at least one selected from polyurethane-based elastic yarns and polyester-based elastic yarns.

12. The underpant garment according to claim 7, wherein the elastic yarn is a bare yarn or a covered yarn whose surface is covered with a polyester fiber.

13. The underpant garment according to claim 1, wherein the underpant garment is a pair of pants worn underneath a baseball uniform.

14. An underpant garment worn in a state of being substantially in close contact with a surface of a lower body of a wearer, the underpant garment comprising a main constituent portion made of stretchable materials that include a first-type material and a second-type material, the first-type material having a straining force greater than a straining force of the second-type material, wherein the first-type material is arranged in regions such that in each region the first-type material covers at least a region including a part of musculus gluteus maximus, a part of musculus gluteus medius, a part of musculus tensor faciae latae, and a part of tractus iliotibialis, and the second-type material is arranged in regions other than the regions where the first-type material is arranged, wherein both of an extension ratio A of a 5 cm-wide piece of the first-type material and an extension ratio B of a 5 cm-wide piece of the second-type material under a load of 17.7 N (1800 gf) are not less than 50%.

15. The underpant garment according to claim 14, wherein the first-type material is arranged so as to further cover at least a portion of musculus adductor magnus in each region.

16. The underpant garment according to claim 14, wherein the first type and second type materials are integrated by sewing.

17. The underpant garment according to claim 14, wherein an extension ratio under a load of 4.9 N (500 gf) of a 5 cm-wide piece of the first-type material is in a range of not less than 20% and less than 50%, while that of a 5 cm-wide piece of the second-type material is in a range of not less than 50%.

18. The underpant garment according to claim 14, wherein each of the first-type material and the second-type material is at least one type of fabric selected from two-way stretchable knitted fabrics and two-way stretchable woven fabrics that are stretchable in a warp direction and a weft direction.

19. The underpant garment according to claim 14, wherein the underpant garment is formed so as to extend to above knees, to under knees, or to ankles.

20. The underpant garment according to claim 18, wherein the two-way stretchable knitted or woven fabric includes a polyester fiber yarn and an elastic yarn as main component constituent yarns.

21. The underpant garment according to claim 18, wherein the two-way stretchable knitted or woven fabric includes a nylon fiber yarn and an elastic yarn as main component constituent yarns.

22. The underpant garment according to claim 18, wherein the two-way stretchable knitted fabric is at least one knitted fabric selected from a fabric knitted by a raschel warp-knitting machine, a fabric knitted by a tricot warp-knitting machine, and a fabric knitted by a weft-knitting machine.

23. The underpant garment according to claim 22, wherein the fabric knitted by a weft-knitting machine is a fabric knitted by a circular-knitting machine or a flat-knitting machine.

24. The underpant garment according to claim 20, wherein the elastic yarn is at least one selected from polyurethane-based elastic yarns and polyester-based elastic yarns.

25. The underpant garment according to claim 20, wherein the elastic yarn is a bare yarn or a covered yarn whose surface is covered with a polyester fiber.

26. The underpant garment according to claim 14, wherein the underpant garment is a pair of pants worn underneath a baseball uniform.

* * * * *